US010814506B2

(12) United States Patent
Darwinkel et al.

(10) Patent No.: US 10,814,506 B2
(45) Date of Patent: Oct. 27, 2020

(54) HAIR CLIPPING DEVICE

(71) Applicant: KONINKLIJKE PHILIPS N.V., Eindhoven (NL)

(72) Inventors: Geert-Jan Darwinkel, Eindhoven (NL); Paul Brulez, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/546,024

(22) PCT Filed: Jan. 27, 2016

(86) PCT No.: PCT/EP2016/051705
§ 371 (c)(1),
(2) Date: Jul. 25, 2017

(87) PCT Pub. No.: WO2016/120329
PCT Pub. Date: Aug. 4, 2016

(65) Prior Publication Data

US 2018/0333876 A1 Nov. 22, 2018

(30) Foreign Application Priority Data

Jan. 28, 2015 (EP) ..... 15152931

(51) Int. Cl.
*B26B 19/44* (2006.01)
*B26B 19/38* (2006.01)
*B26B 19/06* (2006.01)

(52) U.S. Cl.
CPC ..... *B26B 19/44* (2013.01); *B26B 19/3853* (2013.01); *B26B 19/06* (2013.01)

(58) Field of Classification Search
CPC ..... B26B 19/06; B26B 19/38; B26B 19/3853; B26B 19/44; B26B 19/48
USPC ..... 30/123, 124, 133, 208–210, 216; 15/300.1
See application file for complete search history.

(56) References Cited

U.S. PATENT DOCUMENTS 2,294,713 A * 9/1942 Boerger ..... B26B 19/40 30/123
2,542,333 A * 2/1951 Hotz et al. ..... B26B 19/44 30/132

(Continued)

FOREIGN PATENT DOCUMENTS

DE 3919022 A1 12/1989
EP 1216800 A3 * 3/2003 ..... B26B 19/44

(Continued)

*Primary Examiner* — Jason Daniel Prone

(57) ABSTRACT

A hair clipping device includes a cutting assembly having a stationary cutting blade and a moveable cutting blade, where the moveable cutting blade is arranged on a first side with respect to the stationary cutting blade. The hair clipping device further includes a driver configured to drive the moveable cutting blade relative to the stationary cutting blade, and a housing having an air outlet and an air inlet. A fan for generating a pressurized airflow is fluidly connected to the air outlet such that the pressurized airflow exits the housing at the air outlet and at least partly re-enters the housing at the air inlet. The air outlet and the air inlet are both arranged on the first side with respect to the stationary cutting blade.

19 Claims, 4 Drawing Sheets

(56) References Cited

U.S. PATENT DOCUMENTS

| | | | | | |
|---|---|---|---|---|---|
| 2,697,876 | A * | 12/1954 | Blanchard | B26B 19/44 | 30/133 |
| 2,748,472 | A * | 6/1956 | Sheley et al. | B26B 19/44 | 30/133 |
| 2,914,849 | A * | 12/1959 | Watkins | B26B 19/34 | 30/133 |
| 3,384,919 | A * | 5/1968 | Jording et al. | B26B 19/44 | 30/133 |
| 3,979,825 | A * | 9/1976 | Baumann | B26B 19/44 | 30/133 |
| 4,475,285 | A | 10/1984 | Hara et al. | | |
| 4,868,984 | A * | 9/1989 | Elsherbini | B26B 19/44 | 30/133 |
| 5,075,971 | A | 12/1991 | McCambridge | | |
| 6,665,938 | B2 | 12/2003 | McCambridge | | |
| 6,684,511 | B2 * | 2/2004 | McCambridge | B26B 19/44 | 30/133 |
| 6,948,248 | B2 | 9/2005 | Andis | | |
| 6,986,206 | B2 * | 1/2006 | McCambridge | B26B 19/063 | 30/133 |
| 7,076,878 | B2 * | 7/2006 | Degregorio, Jr. | B26B 19/44 | 30/133 |
| 7,228,630 | B2 * | 6/2007 | Obermann | B26B 19/44 | 30/124 |
| 8,484,853 | B1 * | 7/2013 | Laube | B26B 19/44 | 30/133 |
| 8,931,178 | B2 * | 1/2015 | Beam | B26B 19/3853 | 30/123 |
| 9,919,439 | B2 * | 3/2018 | Fu | B26B 19/44 | |
| 10,279,493 | B2 * | 5/2019 | Snow | B26B 19/3886 | |
| 2006/0162516 | A1 * | 7/2006 | Andis | B26B 19/44 | 30/34.05 |
| 2006/0230619 | A1 * | 10/2006 | Williams | B26B 19/44 | 30/133 |
| 2008/0172901 | A1 | 7/2008 | Parziale | | |
| 2009/0277012 | A1 | 11/2009 | Mikula | | |
| 2012/0216410 | A1 | 8/2012 | Beam | | |
| 2015/0224656 | A1 * | 8/2015 | Johnson | B26B 19/44 | 30/133 |
| 2017/0361479 | A1 * | 12/2017 | Magrone | B26B 19/44 | |

FOREIGN PATENT DOCUMENTS

| | | | | | |
|---|---|---|---|---|---|
| EP | 3250349 | B1 * | 3/2019 | B26B 19/44 | |
| GB | 2410457 | A | 8/2005 | | |
| JP | 52009546 | A * | 1/1977 | | |
| WO | 9736719 | A1 | 10/1997 | | |
| WO | 0183172 | A1 | 11/2001 | | |
| WO | WO-2016120329 | A1 * | 8/2016 | B26B 19/44 | |

* cited by examiner

HAIR CLIPPING DEVICE

This application is the U.S. National Phase application under 35 U.S.C. § 371 of International Application No. PCT/EP2016/051705, filed on Jan. 27, 2016, which claims the benefit of European Application No. 15152931.0 filed on Jan. 28, 2015. These applications are hereby incorporated by reference herein.

FIELD OF THE INVENTION

The present invention relates to a hair clipping device, in particular to a hair clipping device with a hair system for catching and collecting cut hairs.

BACKGROUND OF THE INVENTION

Electric hair cutting appliances are generally known and include trimmers, clippers and shavers whether powered by main-supplied electricity or battery-driven. Such devices are generally used to trim body hair, in particular facial and head hair to allow a person to have a well-groomed appearance.

Conventional hair trimming devices, also denoted as hair trimmers, comprise a main body forming an elongated housing having a front or cutting end and an opposite handle end. A cutting assembly is disposed at the front end. The cutting assembly usually comprises a stationary cutting blade, which is sometimes also referred to as "guard", and a moveable cutting blade, which is sometimes also referred to as "cutter". The moveable cutting blade is displaceably mounted on the top surface of the stationary cutting blade and resiliently biased against said top surface of the stationary cutting blade. The moveable cutting blade is usually driven by a motor in an oscillatory manner relative to the stationary cutting blade. The movement of the motor is typically transferred to the stationary moveable cutting blade via a drive shaft that is arranged between the motor and a coupling element which is fixed to the moveable cutting blade. Said coupling element is often denoted as "driving bridge". One or more spring elements are used for biasing the moveable cutting blade against the stationary cutting blade in order to receive the so-called teeth pressure during hair cutting.

A typical problem of such hair trimmers is the problem that hairs get sprayed around almost randomly. Everybody who has already used such a hair trimmer is aware of this problem. During usage cut hairs get sprayed all over the place and pollute the bathroom. This is especially unpleasant for other family members making use of the same bathroom. The tooth brush, the soap, the mirror, the sink and other accessories within the bathroom are often full of whiskers.

A lot of manufacturers have already tried to tackle the above-mentioned unwanted hair spraying side effect of hair trimmers. A typical solution includes the application of a vacuum/suction system in order to suck in the cut hairs and collect them anywhere in the interior of the hair trimmer housing. An example of such a hair trimmer with a suction unit is known from US 2009/02770912 A1.

However, it has been shown that solutions using vacuum/suction units are in practice not efficient enough. Typical hair catching efficiency values of such hair trimmers are maximally between 75-90%, meaning that at most 75-90% of the cut hairs can be sucked in and collected, while the remaining 10-25% are still spraying around within the bathroom.

Tests of the applicant have shown typical launching speeds of cut hairs in a range of up to 6 m/s. This means that such vacuum systems need to be capable to create a powerful localized counter air speed above 6 m/s. On the other hand, vacuum technology is by itself limited, since the bear minimum of vacuum is close to $1\times10^{-8}$ bar. This would "only" provide a pressure drop of 1 bar at maximum. To achieve such a strong vacuum one would need to use a vacuum source providing power of more than 500 W, i.e. similar vacuum sources as used in vacuum floor cleaning machines. Of course, this is in practice not realistic, already because of the limited space. Hair trimmers usually have motors in a 2-6 W power range.

In the so far known hair trimmers with vacuum/suction systems a fan is used to create suction/vacuum. The rotation speed of the fan is furthermore limited due to sound restrictions and user sound acceptance levels. The ergonomics of a hand-held trimming appliance also have limitations towards the maximum fan size. Thus, fan size and rotation speed limitations make suction air speed above 6 m/s difficult, especially in large "hair spray areas" which require a bigger entrance nozzle.

One also has to consider the following geometrical dilemma: The bigger the nozzle entrance, the lower the air speed (distributed over a large area), i.e. the lower the suction effect. The smaller the nozzle entrance, the higher the air speed (localized in a very small area), i.e. the higher the suction effect, however, only in a very limited and focused area.

An alternative solution is known from U.S. Pat. No. 5,075,971 A. The therein disclosed hair clipping device uses also a suction fan. However, in addition to a suction air inlet that is arranged below the stationary cutting blade, an air outlet is arranged above the moveable cutting blade through which pressurized air exits the hair clipper housing. The pressurized air thus passes across the moveable and the stationary cutting blade, wherein the created air pressure shall inhibit an undesired accumulation of cut hair strands in the blades. However, the blowing direction of this blowing airflow is arranged outwards from the cutter perspective, i.e. in the direction from the back end of the cutter to the front end of the cutter where the cutting teeth are located. Tests have shown that such a blowing airflow does not contribute to the hair collection performance. It actually counteracts the hair collection, because cut hairs are blown away from the appliance, as the direction of the blowing airflow is almost the same as the typical launching direction of the cut hairs. This blowing airflow may thus only be used as clogging prevention of the blades, but not as an effective collecting and catching mechanism of cut hairs.

There is thus still room for improvement.

SUMMARY OF THE INVENTION

It is an object of the present invention to provide a hair clipping device which overcomes the above-mentioned problems. It is particularly an object to provide a hair clipping device that overcomes the unwanted side effect of cut hairs getting sprayed around. Compared to known devices, the hair catching and collecting efficiency shall be increased while the overall size of the hair clipping device shall remain as small as possible and the power consumption is kept as low as possible.

This problem is solved by a hair clipping device comprising:

- a cutting assembly having a stationary cutting blade and a moveable cutting blade, wherein the moveable cutting blade is arranged on a first side with respect to the stationary cutting blade;

a drive arrangement for driving the moveable cutting blade relative to the stationary cutting blade;

a housing having an air outlet and an air inlet;

a fan for generating a pressurized airflow, the fan being fluidly connected to the air outlet, such that the pressurized airflow exits the housing at the air outlet and at least partly re-enters the housing at the air inlet;

wherein the air outlet and the air inlet are both arranged on the first side with respect to the stationary cutting blade: and wherein the air outlet comprises a curved guiding surface for deflecting the airflow towards the air inlet.

One of the central features of the present invention is the usage of a fan for generating a pressurized airflow instead of or in addition to a vacuum aggregate or suction unit. The cut hairs or whiskers are thus not collected by means of a suction/intake airflow (under-pressurized airflow) but by means of a blowing airflow (over-pressurized airflow). This blowing airflow is used to block and transport the cut hairs to a predefined location within the housing, e.g. to a hair container. The fan, which is used therefore, is preferably configured to generate a pressurized airflow with a speed at the air outlet being higher than the launching speed of the cut hairs (i.e. preferably above 6 m/s, most preferably above 9 m/s) in area around or near the cutting assembly. The main advantage of such a blowing airflow compared to suction airflows is the inherent physical ability to create an overpressure in a technically easier manner than an underpressure (vacuum). A blowing airflow is apart from that easier to direct and to control. An illustrative example for this phenomena is the following: Ten adults have almost no chance to suck out candles on a birthday cake, while one child has no problem blowing out the birthday candles at a single blow.

Another characteristic of the present invention is the direction of the pressurized airflow. In contrast to the solution proposed in U.S. Pat. No. 5,075,971 A, the pressurized airflow is not directed across the moveable and the stationary cutting blade from the top to the bottom of the cutting assembly, but is rather directed to flow over the top face of the moveable cutting blade and from there back into the housing again. The term "at least partly re-enters the housing" shall herein mean that at least a part of the airflow exiting the housing at the air outlet re-enters the housing again at the air inlet. It is preferred that the majority, i.e. more than 50% of the airflow re-enters the housing, even more preferred is that more than 90% of the airflow re-enters the housing again.

The air outlet and the air inlet are both arranged on the first side with respect to the stationary cutting blade, wherein the first side denotes the side of the stationary cutting blade that faces towards the moveable cutting blade. In other words, this means that the stationary cutting blade and the moveable cutting blade contact each other along a cutting plane, wherein the moveable cutting blade is arranged on the first side of the cutting plane and the stationary cutting blade is arranged on the second side of the cutting plane, and wherein the air outlet and the air inlet are both also arranged on the first side of the cutting plane. The result is a circulating airflow over the top face of the moveable cutting blade, i.e. the side of the moveable cutting blade that faces away from the stationary cutting blade.

Experiments of the applicant have shown that the hair clipping device according to the present invention provides a significantly increased hair catching and collecting efficiency compared to hair clipping devices using vacuum or suction units and also compared to the device known from U.S. Pat. No. 5,075,971 A. Some tests have even shown a hair catching and collecting efficiency value of above 95%.

The air outlet comprises a curved guiding surface for deflecting the airflow towards the air inlet. The airflow does therefore not exit the housing in a straight manner, but is already deflected onto a curved trajectory before leaving the housing. This provides the advantage that leakages are minimized as much as possible, since the airflow is already directed towards the air inlet (i.e. back into the housing again) when exiting the housing. Preferably more than 90% of the pressurized airflow exiting the air outlet thus re-enters the housing at the air inlet again together with the cut hairs.

Preferred embodiments of the invention are defined in the dependent claims.

The air outlet and the air inlet are, according to a preferred embodiment, separated from each other by a wall element which comprises a rounded end portion at its free end. The air outlet is preferably defined by the curved guiding surface and the rounded end portion of the wall element. The term "rounded" shall not necessarily imply circular or semi-circular, but may also include parabolic or elliptical shapes, as long as it is not angular.

The pressurized airflow exits the housing locally in between the rounded end portion of the separating wall element and the curved guiding surface. The rounded end portion provides the advantage that it helps to deflect the pressurized airflow onto a substantially U-shaped path from the air outlet to the air inlet. The reason is the so-called Coandã effect due to which the airflow gets attracted to the rounded end portion of the wall element and thereby deflected. The wall element is preferably arranged transverse to the cutting assembly, and the curved guiding surface is preferably arranged substantially parallel to the rounded end portion, such that a majority of the pressurized airflow flows in a substantially U-shaped airflow from the air outlet, in a tangential manner over the top face of the moveable cutting blade, towards the air inlet. The term "transverse" shall not necessarily imply perpendicular, but rather non-parallel. The U-turn caused by the Coandã effect also provides the advantage that rather high airflow speeds may be achieved.

As already mentioned above, the drive arrangement of the hair clipping device comprises a motor, and a drive shaft for transferring the power of the motor to the moveable cutting blade. The drive shaft is usually arranged at or near the centre of the housing.

It is according to the present invention especially preferred that the air outlet has a larger distance from the drive shaft than the air inlet. The air inlet is, in other words, arranged closer to the central or longitudinal axis of the housing than the air outlet. The pressurized airflow is thus so to say directed inwards from the cutter (moveable cutting blade) perspective. The pressurized airflow preferably flows in a tangential manner from the front end of the moveable cutting blade where the cutting teeth are arranged towards the back end of the moveable cutting blade. The pressurized airflow is therefore arranged almost exactly opposite to the launching direction of the cut hairs. The cut hairs may thus be directly blocked and transported into the interior of the housing.

The fan is fluidly connected to the air outlet via an outlet channel. According to an embodiment, it is preferred that a cross-section of the outlet channel is constricted at or near the outlet channel. Such a constriction at or near the air outlet provides the advantage that the speed/velocity of the pressurized airflow is significantly increased at the air outlet which again increases the hair catching and collecting efficiency. It shall be noted that such a constriction decreases the flow rate of the airflow (due to a smaller area), but increases the velocity of the airflow. A higher pressure drop occurs between the air outlet and the air inlet. Less airflow but higher air speeds also means less power consumption such that smaller fans may be used that consume less energy. This in turn also provides a volume benefit as smaller sized fans may be used.

The constriction of the outlet channel is preferably realized by means of the wall element that separates the air outlet from the air inlet. To provide this function it is especially preferred that the cross section of the wall element is locally increased in the area of the free end of the wall element. The increased cross section of the wall element does not only lead to a constriction of the outlet channel near the air outlet but also to a constriction of the inlet channel near the air inlet. This again provides the advantage that already caught and collected hairs are prevented from falling out of the housing even if the device is turned off and the fan is not blowing anymore. However, it shall be noted that during operation the air speeds are anyhow strong enough to prevent hairs from falling out even if the appliance is held upside down.

According to a further embodiment, the air outlet is fluidly connected to an outlet of the fan, and the air inlet is fluidly connected to an inlet of the fan, such that a (re-) circulating airflow is created. In this embodiment it is especially preferred that the hair clipping device further comprises a filter mesh which is arranged between the air inlet and the inlet of the fan. According to a specific embodiment, this filter mesh has a conical or frustoconical shape. The fan is preferably realized as a radial fan.

A conical or frustoconical filter mesh on the one hand provides the advantage of a relatively large filter surface. On the other hand, a conical or frustoconical filter may act as clogging prevention, since the filtered hairs/whiskers glide along the inclined outer plane of the conical filter due to gravity, such that there is always a part of the filter that is un-clogged/open.

However, it shall be noted that the system does not necessarily have to be realized as a re-circulating, close-loop system. In an alternative embodiment the air inlet is not connected to the air intake of the fan. The fan in this case sucks in air from outside of the housing, while no suction effect occurs at the air inlet. The cut hairs/whiskers are then "only" caught and collected by means of the pressurized (blowing) airflow that exits the air outlet and re-enters the air inlet. In this case it is especially preferred that the device further comprises an exhaust air port comprising a filter mesh which is arranged in an external wall of the housing separating the hair container from the exterior of the hair clipping device.

According to a further embodiment, the drive arrangement comprises a motor, a driving bridge which is connected to the moveable cutting blade, and a drive shaft which connects the motor to the driving bridge, wherein the driving bridge is at least partly covered by a protective casing, and wherein the air inlet is defined by the protective casing and the rounded end portion of the above-mentioned wall element that separates the outlet channel from the inlet channel.

The function of said protective casing is two-fold: On the one hand, it protects parts of the drive arrangement (i.e. the driving bridge) from getting polluted with cut hairs. On the other hand, it defines the air inlet together with the rounded end portion of the wall element and thereby provides the above-mentioned constriction of the inlet channel at or near the air inlet that increases the pressure drop and helps preventing cut hairs from falling out of the housing again.

According to a further embodiment, the protective casing may comprise an inlet opening which is fluidly connected to the air inlet and an outlet opening which opens out into the hair container.

In this embodiment parts of the pressurized airflow flows through the interior of the protective casing and thereby cools the back part of the moveable cutting blade and the driving bridge. The main advantage of this embodiment is, however, that the interior of the protective casing is getting cleaned from whiskers and cut hairs by means of the pressurized air flow. Cut hairs anyhow reach the interior of the protective casing even if not extra inlet opening is foreseen. The reason is as follows: The protective casing is arranged above the top face of the moveable cutting blade, i.e. on the first side of the moveable cutting blade which is opposite to the side of the moveable cutting blade that faces towards the stationary cutting. Since the moveable cutting blade is moving during operation, the protective casing may not directly contact the moveable cutting blade, such that a small gap occurs anyhow in between the moveable cutting blade and the protective casing. Hence, cut hairs may reach the interior of the protective casing via this small gap. Arranging an extra inlet and outlet opening within the protective casing provides the advantage that the aforementioned cut hairs, which get collected within the interior of the protective casing, are blown out of the protective casing and collected within the hair container.

BRIEF DESCRIPTION OF THE DRAWINGS

These and other aspects of the invention will be apparent from and elucidated with reference to the embodiments described hereinafter. In the following drawings

DETAILED DESCRIPTION OF THE EMBODIMENTS

Figure 1:
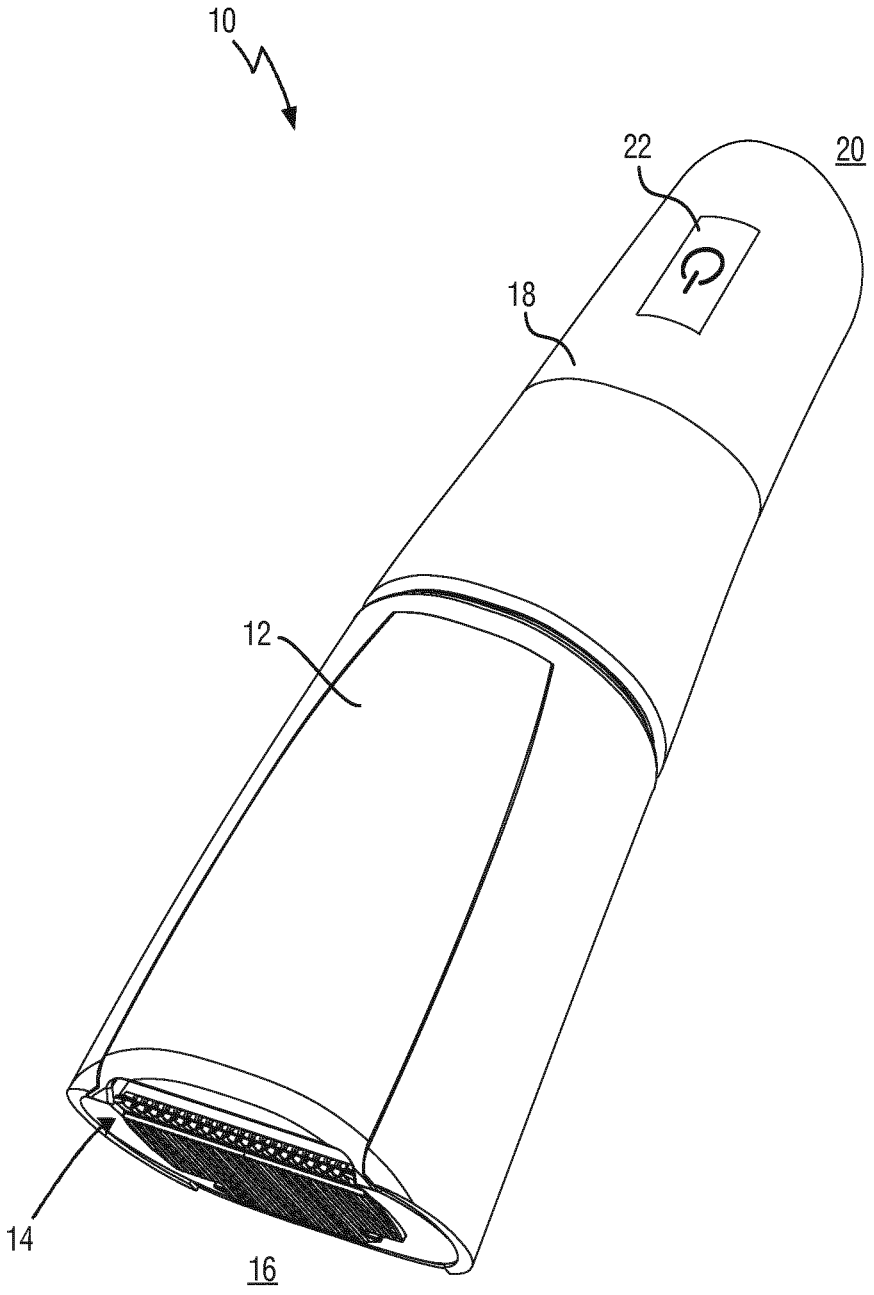
FIG. 1 shows a perspective view of a hair clipping device according to the present invention.

FIG. 1 shows an embodiment of a hair clipping device according to the present invention in a perspective view. The hair clipping device is in its entirety denoted with reference numeral 10.

The hair clipping device 10 comprises a housing 12. The housing 12 connects all parts of the hair clipping device 10 together and also serves as a skeleton for a cutting assembly 14. The cutting assembly 14 is fixedly or releasably attached to the front end 16 of the housing 12. The housing 12 has an elongated body which comprises a handle 18 at its rear end 20. The outer surface of the elongated housing 12 may be tapered slightly outwardly from the rear end 20 to the front end 16 and may have a slightly bent development to provide a more ergonomic holding position and to improve the esthetic appearance of the hair clipping device 10. It shall be noted that also other housing arrangements and designs are envisaged without leaving the scope of the present invention.

The hair clipping device 10 further comprises an user interface 22 for controlling the operation of the hair clipping device 10. The user interface 22 is in the presented example for simplicity reasons "only" shown as a regular on/off button. However, in practice the user interface 22 may comprise further buttons, e.g. one or more buttons for increasing and/decreasing the hair cut length setting, and a display which shows the user the currently set hair cut length as well as some other information, e.g. the battery status etc. The user interface 22 may also comprise a touchscreen which provides the afore-mentioned functions of the buttons and the display all in one.

Figure 2:
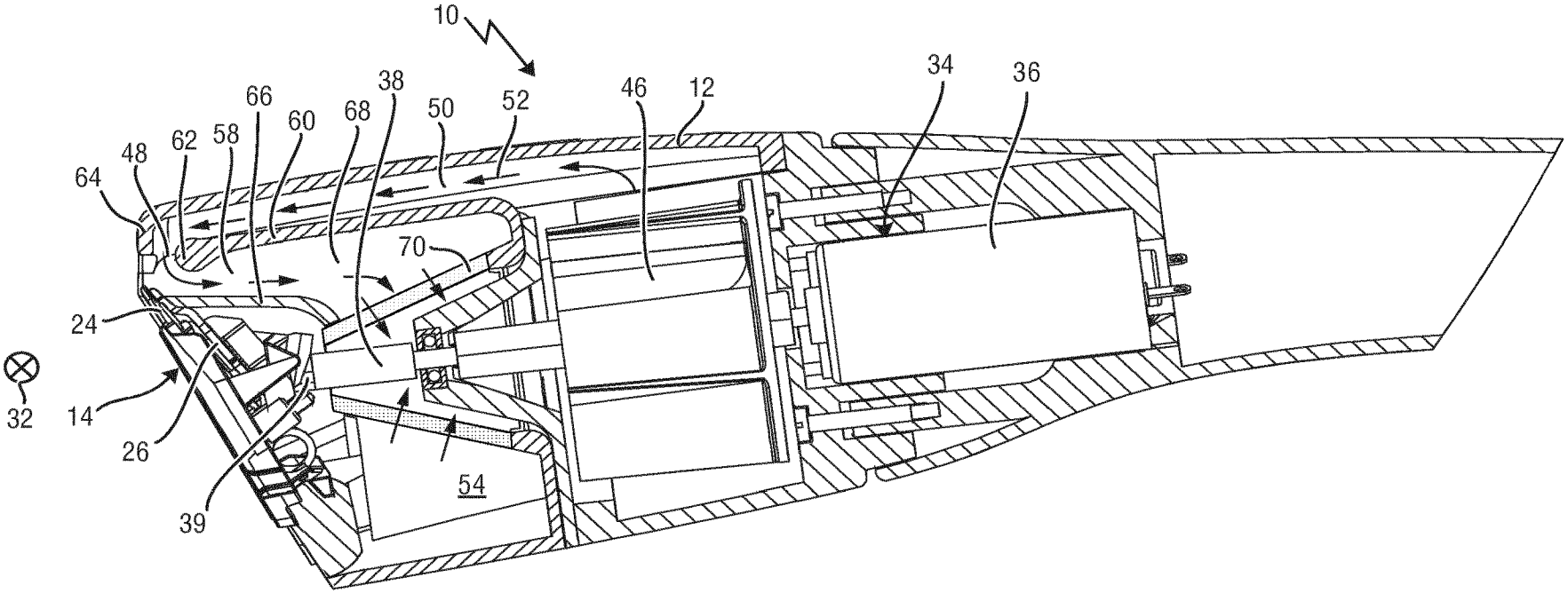
FIG. 2 shows a sectional view of a first embodiment of the hair clipping device according to the present invention.
Figure 3:
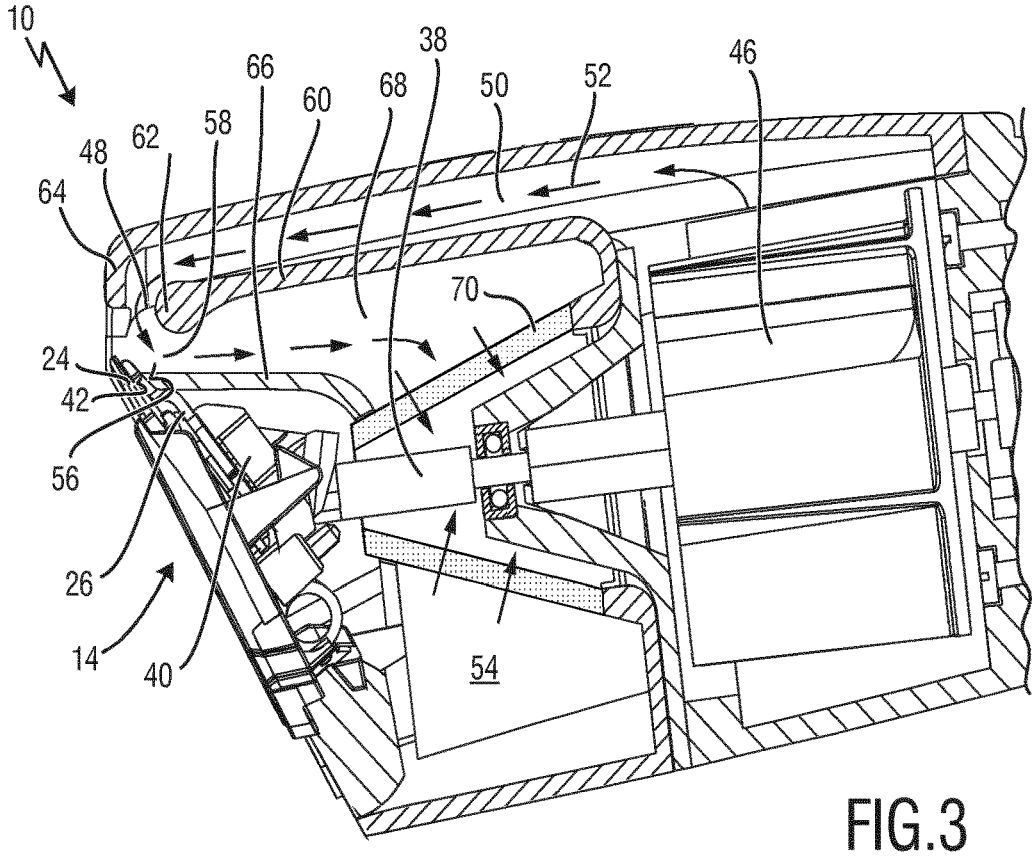
FIG. 3 shows a detail of FIG. 2.
Figure 4:
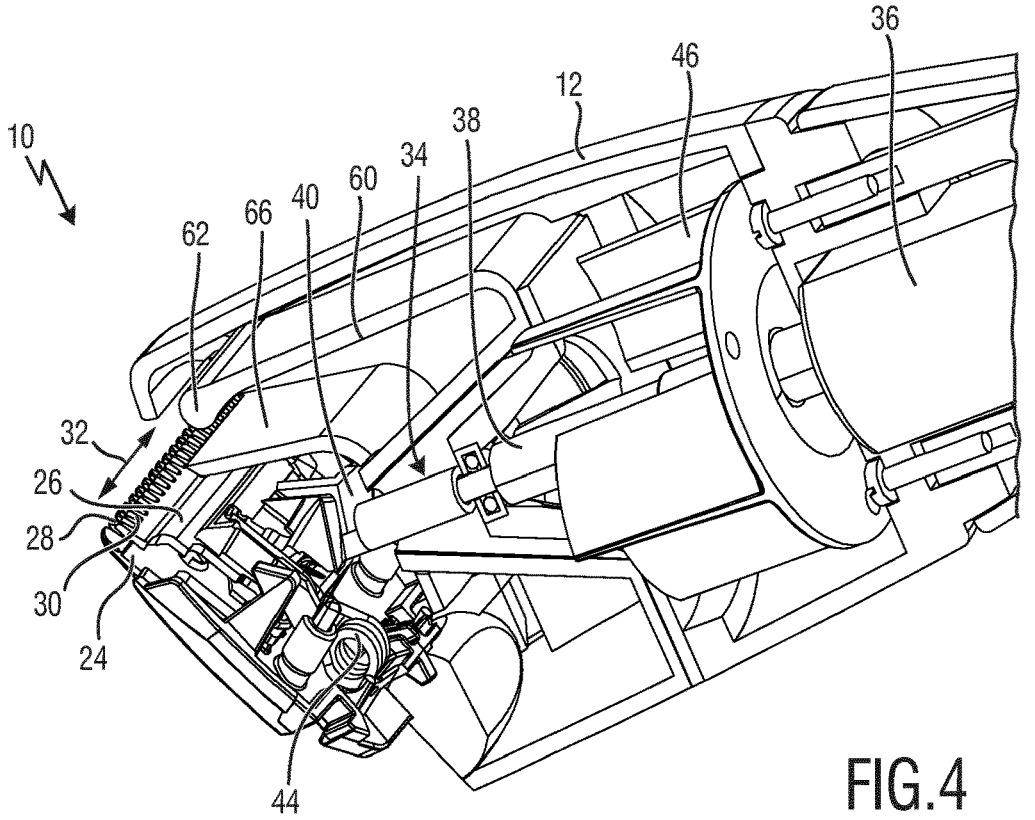
FIG. 4 shows a perspective sectional view of the embodiment shown in FIGS. 2 and 3.

The cutting assembly 14 includes a stationary cutting blade 24 and a moveable cutting blade 26 (see e.g. FIGS. 2-4). The moveable cutting blade 26 is displaceably mounted on a top face 42 of the stationary cutting blade 24 which top face 42 faces substantially towards the inside of the housing 12. The stationary cutting blade 24 and the moveable cutting blade 26 each comprise an array of cutting teeth 28, 30. These cutting teeth 28, 30 are preferably arranged substantially parallel to one another. During operation of the hair clipping device 10 hair cutting is performed due to the interaction of the stationary cutting blade 24 and the moveable cutting blade 26. The moveable cutting blade 26 reciprocates in an oscillatory manner along a first axis 32 relative to the stationary cutting blade 24. This oscillatory movement is generated by a drive arrangement 34.

The drive arrangement 34 comprises a motor 36 that is either driven by main supplied electricity or battery-driven. The motor 36 drives a drive shaft 38 in a rotary manner. This drive shaft 38 is typically coupled via an eccentric element 39 to a so-called driving bridge 40. The driving bridge 40 is attached to the moveable cutting blade 26. The driving bridge 40 is used as a coupling element that couples the drive shaft 38 or the eccentric element 39 of the drive shaft 38 to the moveable cutting blade 26 in order to translate the rotary motor movement into a translational, oscillatory, reciprocal movement of the moveable cutting blade 26 along the first axis 32.

The stationary cutting blade 24 is usually designed to be thicker than the moveable cutting blade 26. Said stationary cutting blade 24 is also denoted as "guard". Its front edge may either be designed as a sharp continuous edge or, similar as the moveable cutting blade 26, as a toothed edge with an array of cutting teeth 28, as this is exemplarily shown in the presented example. The moveable cutting blade 26 is also denoted as "cutter".

In order to receive a good cutting performance the moveable cutting blade 26 is actively pressed onto the top face 42 (see e.g. FIG. 3) of the stationary cutting blade 24 to receive a so-called teeth pressure. A spring 44 (see FIG. 4) is usually used to supply said teeth pressure by resiliently biasing the moveable cutting blade 26 against the top face 42 of the stationary cutting blade 24.

One of the central features of the present invention relates to a mechanism for catching and collecting cut hairs/whiskers. This mechanism is integrated into the hair clipping device 10. The mechanism includes a fan 46 for generating a pressurized airflow.

The fan 46 is preferably realized as a radial fan. In the presented example the fan 46 is mounted onto the same drive shaft 38 that is also used for driving the moveable cutting blade 26. This has the advantage that one and the same motor 36 may be used for the hair cutting operation as well as for the generation of the pressurized airflow. However, it shall be noted that other types of fans may be used, such as an axial fan, a mixed flow fan (combination of axial and radial fan, and it is also possible to use more than one fan without leaving the scope of the present invention.

The fan 46 is fluidly connected to an air outlet 48 via an outlet channel 50. It is important to note that the fan 46 creates a blowing airflow, i.e. an over-pressurized airflow. This blowing airflow exits the housing 12 at the air outlet 48, as this is indicated by means of arrows 52.

The generated pressurized airflow is used to prevent the cut hairs and whiskers from spraying around by blocking them and transporting them into a hair container 54 which is arranged within the housing 12. The hair container 54 may either be realized as a simple, fixed compartment of the housing 12 or as a separate compartment or box that may be detached from the housing 12 in order to dispose the collected hairs and whiskers.

FIG. 2 schematically shows the trajectory of the airflow by means of arrows 52. As illustrated therein, the generated airflow 52 exits the housing 12 at the air outlet 48, makes a kind of U-turn and re-enters the housing 12 at an air inlet 58 again. During the U-turn the airflow 52 flows in a substantially tangential manner over a top face 56 of the moveable cutting blade 26. Said top face 56 of the moveable cutting blade 26 denotes the side of the moveable cutting blade 26 that is opposite to the surface with which the moveable cutting blade 26 contacts the stationary cutting blade 24.

The afore-mentioned substantially U-shaped airflow that flows over the top face 56 of the moveable cutting blade 26 and thereby catches the cut hairs and transports them to the hair container 54 is structurally achieved as follows: First of all, it is important to note that the airflow 52 flows from the air outlet 48 towards the air inlet 58. Both the air outlet 48 and the air inlet 58 are arranged on the same side of the stationary cutting blade 24, i.e. on the side of the stationary cutting blade 24 on which also the moveable cutting blade 26 is arranged. Said side of the stationary cutting blade 24 is herein generally denoted as "first side". The opposite second side of the stationary cutting blade 24 faces to the exterior of the housing 12. The air outlet 48 and the air inlet 58 are separated from each other by means of a wall element 60. This separating wall element 60 preferably comprises a rounded tip portion 62 at its free end. This rounded tip portion 62 has a significant influence on the deflection of the airflow in the area between the air outlet 48 and the air inlet 58. The airflow 52 has the tendency to be attracted to the exterior surface of the rounded tip portion 62 and is thereby deflected into its U-shape that is schematically illustrated in FIG. 2. This effect is also known as Coandã effect. The rounded tip portion may, but does not have to be partly cylindrical. It may also be a part of an elliptical cylinder or even spherical. Most preferably the rounded tip portion has a parabolic shape. However, it shall be noted that it is not only the rounded tip portion 62 that creates the illustrated U-shape of the airflow between the air outlet 48 and the air inlet 58. The air outlet 48 furthermore comprises a curved guiding surface 64 that deflects the airflow 52 towards the air inlet 58. The air outlet 48 is thus defined by the curved guiding surface 64 and the rounded tip portion 62. The curved guiding surface 64 may be arranged substantially parallel to the rounded tip portion 62.

The above-mentioned arrangement that leads to the illustrated type of airflow 52 has the following advantages: A blowing airflow is used instead of a suction/intake airflow. Blowing airflows are physically more powerful and by far better to control. Better to control means that blowing airflows are easier to direct. Apart from that, higher air speeds may be generated with less power compared to suction airflows. Another main characteristic of the present invention is the fact that the system is not optimized for high flow rates, but instead for higher airflow velocities at very specific and advantageous locations.

As it may be seen in FIG. 2, the air outlet 48 is arranged further outside than the air inlet 58, meaning that the distance between the air outlet 48 and the drive shaft 38 or the central longitudinal axis of the housing 12 is larger than the distance between the air inlet 58 and the drive shaft 38. The generated airflow 52 flows over the top face 56 of the moveable cutting blade 26 from its front end where the cutting teeth 30 are arranged towards its back end. The airflow 52 between the air outlet 48 and the air inlet 58 is thus arranged almost exactly opposite to the typical launching direction of the cut hairs. Tests of the applicant have therefore shown a relatively high hair catching efficiency value of above 90% or even above 95%.

The air speed at the air outlet 48 may be increased by choking/constricting the outlet channel 50 at or near the air outlet 48. Such a constriction may be created by an increased cross section of the wall element 60 in the area of its free end where the rounded tip portion 62 is arranged. Such a constriction leads to a higher pressure drop area that leads to a decreased flow rate but increased local air speed. Less flow rate also means less power consumption as a secondary beneficial side effect (smaller fans may be used). However, it shall be noted that such a constriction also increases the turbulence of the airflow 52 at or near the air outlet 48.

The air inlet 58 is preferably defined between the wall element 60 (specifically the rounded tip portion 62 of the wall element 60) and a protective casing 66. The function of the protective casing 66 is two-fold: On the one hand it helps to define the air inlet 58 and parts of the air inlet channel 68 on the other hand, it protects the driving bridge 40 as well as the connection between the driving bridge 40 and the drive shaft 38. The cross section of the air inlet channel 68 is in the shown example also constricted at or near the air inlet 58 (due to the increased cross section of the wall element 60 in this area). Said constriction does not only have fluid dynamical reasons but also helps preventing cut hairs from falling out of the system when the fan 46 is turned off. The airflow 52 is according to the first embodiment shown in FIGS. 2 and 3 realized as a (re-)circulating air flow, meaning that the generated pressurized airflow leaves the fan 46, flows through the outlet channel 50, exits the housing 12 at the air outlet 48, at least partly re-enters the housing 12 at the air inlet 58, flows along the inlet channel 68, and is finally sucked back into the fan 46. The inlet of the fan 46 is thereto fluidly connected to the air inlet 58. The term "at least partly re-enters" shall mean that not necessarily the whole air flow re-enters the housing 12 at the air inlet 58 again, i.e. some losses may occur. However, it is preferred that at least the majority of the air flow re-enters the air inlet 58. It is especially preferred that more than 80%, or even more than 90% of the air flow re-enters the housing 12 again.

The hair clipping device 10 according to the first embodiment shown in FIGS. 2 and 3 furthermore comprises a filter mesh 70. This filter mesh filters the collected cut hairs/whiskers and is arranged between the inlet channel 68 and the inlet of the fan 46. In the shown example, the filter mesh 70 has a substantially conical or frustoconical shape. This shape has the advantage of providing a relatively large exterior surface. A further advantage is the fact that such a conical filter mesh 70 efficiently prevents a clogging of the filter due to its shape. Filtered hairs usually glide along the exterior surface of the filter mesh 70 due to gravity forces such that, compared to a two-dimensional flat filter, some areas of the filter mesh are always free/un-clogged.

Figure 5:
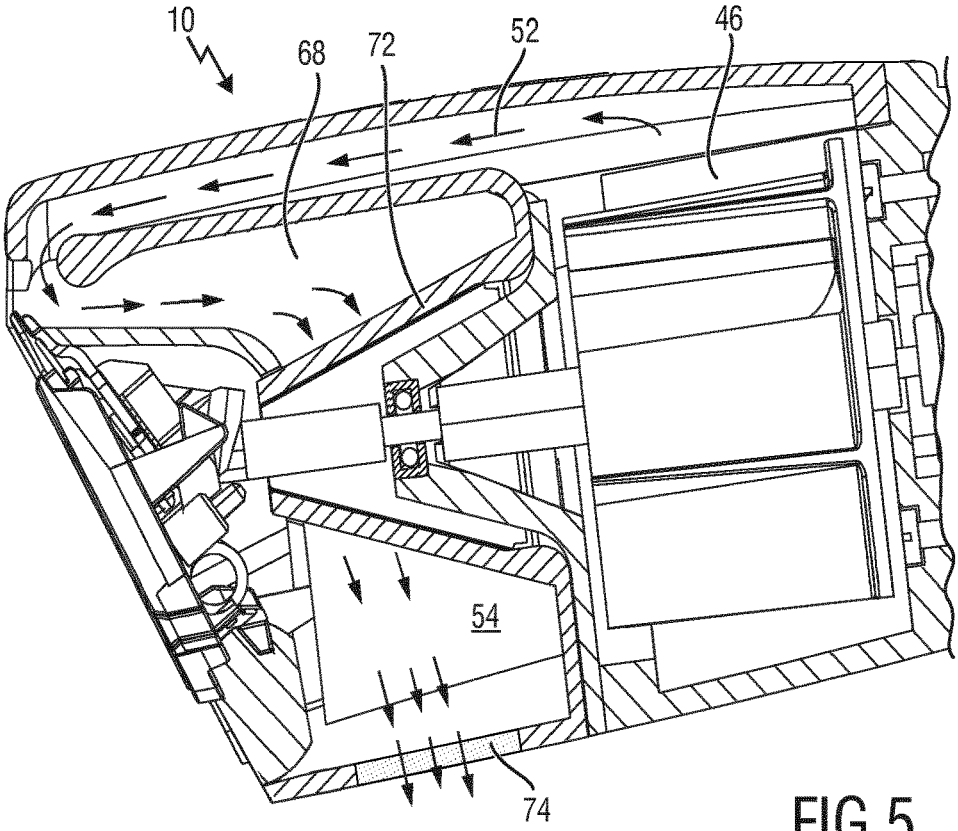
FIG. 5 shows a detail of a sectional view of a second embodiment of the hair clipping device according to the present invention.

FIG. 5 shows a second embodiment of the hair clipping device 10 according to the present invention. The general hair catching and collecting concept is the same as in the first embodiment shown in FIGS. 2 and 3. In contrast to the first embodiment, the airflow 52 is in this case, however, not realized as a re-circulating airflow. The air inlet channel 68 is not fluidly connected to the inlet of the fan 46. A closed cover 72 is provided instead of the filter mesh 70. The second embodiment shown in FIG. 5 comprises a filter mesh 74 which is arranged in an external wall of the housing 12 separating the hair container 54 from the exterior of the hair clipping device 10. The airflow 52 is thus not directed back to the fan 46 but exhausts through the filter mesh 74.

Figure 6:
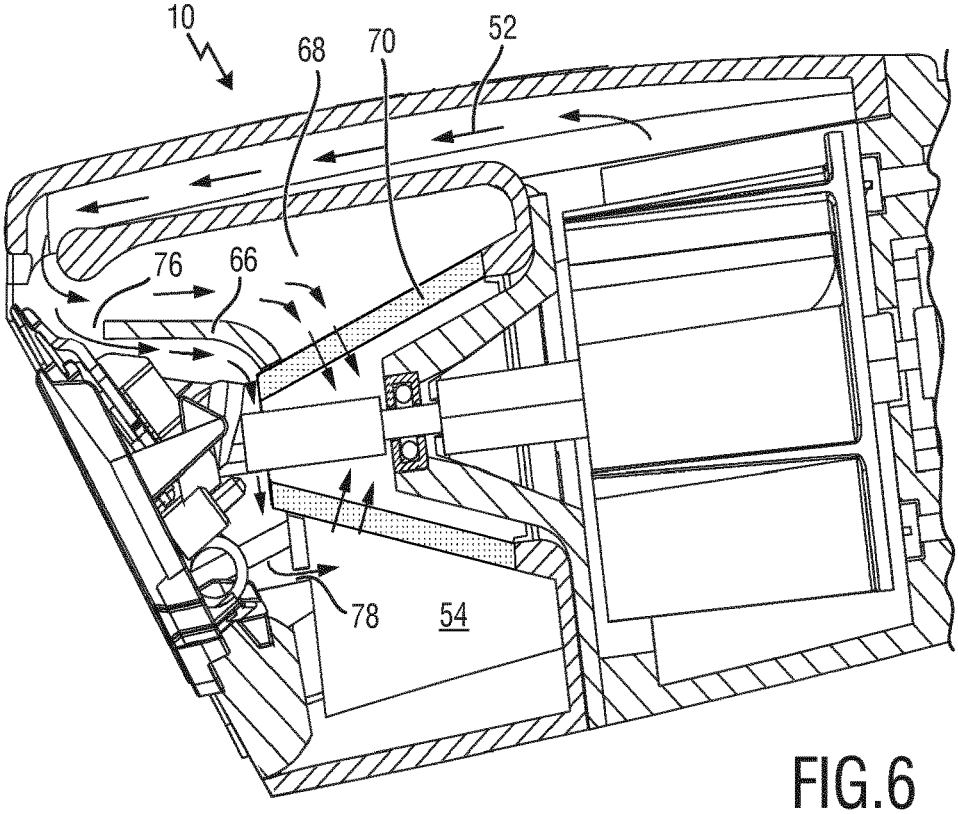
FIG. 6 shows a detail of a sectional view of a third embodiment of the hair clipping device according to the present invention.

FIG. 6 shows a third embodiment of the hair clipping device 10 according to the present invention. This third embodiment is pretty similar as the first embodiment shown in FIGS. 2 and 3 and "only" includes a modification in the configuration of the protective casing 66. The protective casing 66 in this case comprises an inlet opening 76 that is arranged near the air inlet 58 and an outlet opening 78 which opens out into the hair container 54. These two openings 76, 78 in the protective casing 66 lead to the fact that apart of the airflow 52 is guided through the interior of the protective casing 66. This decreases the risk of hairs getting stuck in the interior of the protective casing 66. It shall be noted that cut hairs anyhow enter the interior of the protective casing 66 even though this is not wanted. The reason for this is that the protective casing may not contact the moveable cutting blade 66 such that a small gap occurs through which the cut hairs may be sucked into the interior of the protective casing 66. Using a part of the airflow to transport these cut hairs out of the protective casing 66 again is thus beneficial.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair clipping device comprising:

a housing having an air outlet and an air inlet;

a cutting assembly attached to the housing and having a stationary cutting blade and a moveable cutting blade, wherein the moveable cutting blade is arranged on a first side with respect to the stationary cutting blade, the first side being a side of the stationary cutting blade that faces towards the moveable cutting blade;

a drive arrangement located in the housing for driving the moveable cutting blade relative to the stationary cutting blade; and a fan located in the housing and coupled to the drive arrangement for generating an airflow towards the air outlet, wherein the housing includes a curved guiding surface partly forming the air outlet for deflecting the airflow towards the air inlet such that the airflow exits the air outlet and enters the air inlet, and wherein the air outlet and the air inlet are both arranged on the first side with respect to the stationary cutting blade; and wherein the air outlet and the air inlet are partly formed by a curved end portion of a wall element of the housing and the air inlet is formed between the curved end portion and a casing of the housing.

2. The hair clipping device according to claim 1, wherein the air outlet and the air inlet are partly formed by a curved end portion of a wall element of the housing and the air outlet is defined by the curved guiding surface and the curved end portion of the wall element.

3. The hair clipping device according to claim 1, wherein the air outlet and the air inlet are partly formed by a curved end portion of a wall element of the housing and the air inlet is formed by a casing of the housing and the wall element, wherein the casing and the wall element are arranged such that a majority of the airflow flows in a substantially U-shaped airflow from the air outlet, in a substantially tangential manner over a surface of the moveable cutting blade, towards the air inlet, and wherein said surface of the moveable cutting blade faces away from the stationary cutting blade.

4. The hair clipping device according to claim 1, wherein the drive arrangement comprises a motor and a drive shaft for transferring power of the motor to the moveable cutting blade and fan, wherein the air outlet has a larger distance from the drive shaft than the air inlet.

5. The hair clipping device according to claim 1, wherein the fan is fluidly connected to the air outlet via an outlet channel formed between a first wall and a second wall of the housing, the first wall including the curved guiding surface, and wherein a cross-section of the outlet channel is constricted at or near the air outlet.

6. The hair clipping device according to claim 1, further comprising a hair container for collecting cut hairs, wherein the hair container is arranged within the housing and fluidly connected to the air inlet via an inlet channel formed between a first wall and a second wall of the housing.

7. The hair clipping device according to claim 6, wherein a cross-section of the inlet channel is constricted at or near the air inlet.

8. The hair clipping device according to claim 6, further comprising an exhaust air port comprising a filter mesh which is arranged in an external wall of the housing separating the hair container from the exterior of the hair clipping device.

9. The hair clipping device according to claim 1, wherein the air outlet and the air inlet are fluidly connected to the fan by air channels located in the housing such that a circulating airflow is created.

10. The hair clipping device according to claim 1, wherein the drive arrangement comprises a motor, a driving bridge which is connected to the moveable cutting blade, and a drive shaft which connects the motor to the driving bridge and to the fan, wherein the air outlet and the air inlet are partly formed by a rounded end portion of a wall element of the housing, wherein the driving bridge is at least a partly covered by the protective casing, and wherein the air inlet is defined by the protective casing and the rounded end portion of the wall element.

11. The hair clipping device according to claim 10, further comprising a hair container for collecting cut hairs, wherein the hair container is arranged within the housing and fluidly connected to the air inlet via an inlet channel formed between a first wall and a second wall of the housing, wherein the protective casing comprises an inlet opening which is fluidly connected to the air inlet and an outlet opening which opens out into to the hair container.

12. A hair clipping device comprising:

a housing;

a cutter attached to the housing and having a stationary cutting blade and a moveable cutting blade, wherein the moveable cutting blade is arranged on a first side with respect to the stationary cutting blade, the first side being a side of the stationary cutting blade that faces towards the moveable cutting blade;

a fan located in the housing and configured to blow air for generating an airflow flowing from a first channel to a second channel of the housing, the first channel having an air outlet and the second channel having an air inlet, the fan being fluidly connected to the air outlet such that the airflow exits the first channel at the air outlet and at least partly enters the second channel at the air inlet; and a driver located in the housing and configured to drive the fan and the moveable cutting blade relative to the stationary cutting blade, wherein the air outlet of the first channel and the air inlet of the second channel are arranged on the first side with respect to the stationary cutting blade, and wherein the air outlet is partly formed by a curved guiding surface of the housing for deflecting the airflow from the air outlet of the first channel towards the air inlet of the second channel.

13. The hair clipping device of claim 12, wherein the air outlet and the air inlet are partly formed by a curved end portion of a first wall of the housing and the air inlet is formed between the curved end portion and a second wall of the housing.

14. The hair clipping device of claim 12, wherein the air outlet and the air inlet are partly formed by a curved end portion of a first wall of the housing and the air outlet is defined by the curved guiding surface and the curved end portion of the first wall.

15. A hair clipping device comprising:

a housing having a channel and a curved guiding surface;

a cutter attached to the housing and having a stationary cutting blade and a moveable cutting blade, wherein the moveable cutting blade is arranged on a first side with respect to the stationary cutting blade, the first side being a side of the stationary cutting blade that faces towards the moveable cutting blade; and a fan located in the housing and configured to blow air for generating an airflow flowing in in a first part of the channel toward the cutter such that the airflow exits the first part of the channel and flows in a second part of the channel in a direction away from the cutter; and a driver located in the housing and configured to drive the fan and the moveable cutting blade relative to the stationary cutting blade;

wherein the curved guiding surface of the housing is configured to deflect the airflow such that the second portion of the airflow flows in the second part of the channel.

16. The hair clipping device of claim 15, wherein an air outlet of the first part of the channel and an air inlet of the second part of the channel are arranged on the first side with respect to the stationary cutting blade, and wherein the air outlet is formed partly by the curved guiding surface.

17. The hair clipping device of claim 16, wherein the air outlet and the air inlet are partly formed by a curved end portion of a first wall of the housing and the air inlet is formed between the curved end portion and a second wall of the housing, the second wall being closer to an inner portion of the hair clipping device than the first wall, wherein the first wall and the second wall define the second part of the channel and an outer wall of the housing and the first wall define the first part of the channel, and wherein the air outlet is defined by the curved guiding surface and the curved end portion of the first wall.

18. A hair clipping device comprising:

a housing having an air outlet and an air inlet;

a cutting assembly attached to the housing and having a stationary cutting blade and a moveable cutting blade, wherein the moveable cutting blade is arranged on a first side with respect to the stationary cutting blade, the first side being a side of the stationary cutting blade that faces towards the moveable cutting blade;

a drive arrangement located in the housing for driving the moveable cutting blade relative to the stationary cutting blade;

a filter located in the housing and arranged between the air inlet and the fan around the drive arrangement and a fan located in the housing and coupled to the drive arrangement for generating an airflow towards the air outlet, wherein the housing includes a curved guiding surface partly forming the air outlet for deflecting the airflow towards the air inlet such that the airflow exits the air outlet and enters the air inlet, wherein the air outlet and the air inlet are both arranged on the first side with respect to the stationary cutting blade, and wherein the air outlet and the air inlet are fluidly connected to the fan by air channels located in the housing such that a circulating airflow is created.

19. The hair clipping device according to claim 18, wherein the filter has a substantially conical shape.

* * * * *